US011383966B1

(12) United States Patent
Reddy et al.

(10) Patent No.: US 11,383,966 B1
(45) Date of Patent: Jul. 12, 2022

(54) FLUID DISPENSER WITH ANTI-RUN-ON

(71) Applicant: Electrolux Home Products, Inc., Charlotte, NC (US)

(72) Inventors: Lokesha Kodigenahalli Chinnappa Reddy, Anderson, SC (US); Cornel Comsa, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/203,770

(22) Filed: Mar. 17, 2021

(51) Int. Cl.
*B67D 1/00* (2006.01)
*B67D 1/12* (2006.01)
*F25D 23/12* (2006.01)

(52) U.S. Cl.
CPC ..... *B67D 1/1256* (2013.01); *B67D 1/0082* (2013.01); *F25D 23/126* (2013.01)

(58) Field of Classification Search
CPC .... B67D 2001/0089; B67D 2001/0094; B67D 3/041; B67D 3/0019; B67D 3/0025; B67D 3/02; B67D 1/0082; B67D 1/1256; F16K 7/063; F25D 23/126
USPC ..... 222/529, 185.1, 146.6, 517, 105, 212, 222/214
See application file for complete search history.

(56) References Cited

U.S. PATENT DOCUMENTS 2,377,261 A 5/1945 Norris
2,615,668 A * 10/1952 Ernest ..... F16K 7/06 251/7
2,775,374 A * 12/1956 Tamminga ..... B67D 3/041 222/542
2,806,482 A 9/1957 Norris et al.
3,390,860 A * 7/1968 Kavanau ..... F16K 7/063 251/156
3,539,081 A * 11/1970 Norton ..... B67D 3/041 251/9
3,572,407 A 3/1971 Delorme
3,782,430 A 1/1974 Wilska
3,934,758 A 1/1976 Kipp
4,651,898 A * 3/1987 Bell ..... B67D 3/0019 222/129
4,784,297 A * 11/1988 Katz ..... B67D 3/00 222/161
4,930,666 A * 6/1990 Rudick ..... F25D 23/126 222/556

(Continued)

FOREIGN PATENT DOCUMENTS

GB 2470382 5/2015

*Primary Examiner* — Charles P. Cheyney
(74) *Attorney, Agent, or Firm* — Pearne & Gordon LLP

(57) ABSTRACT

A fluid dispenser for a refrigerator having a dispenser housing; a dispenser frame pivotally mounted within the dispenser housing, the dispenser frame with a front face and two side faces and a first gear disposed on one of the side faces; an actuator with a paddle and a lever, the lever interlocking with the dispenser frame such that when the paddle is pushed, the lever causes the dispenser frame to pivot forward; a flexible tube; a fixed compression jaw mounted onto the dispenser housing behind the flexible and compressible tube; a movable compression jaw having a jaw end and a pivot end, the jaw end mounted in front of the flexible tube, the pivot end having a second gear which interlocks with the first gear, such that when the paddle is pushed the first gear rotates the second gear moving the movable jaw away from the flexible tube is provided.

14 Claims, 5 Drawing Sheets

(56) References Cited

U.S. PATENT DOCUMENTS

| | | | | | |
|---|---|---|---|---|---|
| 4,961,508 | A * | 10/1990 | Weimer | B67D 3/041 | 222/207 |
| 5,249,706 | A * | 10/1993 | Szabo | B67D 7/303 | 222/54 |
| 5,297,400 | A | 3/1994 | Benton et al. | | |
| 5,361,942 | A | 11/1994 | Salkeld et al. | | |
| 6,003,734 | A | 12/1999 | Oh | | |
| 6,186,361 | B1 * | 2/2001 | Teetsel, III | B67B 7/26 | 222/105 |
| 6,636,176 | B2 | 10/2003 | Kim et al. | | |
| 6,708,741 | B1 * | 3/2004 | Berry | B67D 3/0025 | 141/351 |
| 9,988,257 | B2 * | 6/2018 | Schneberger | B67D 3/041 | |
| 10,060,539 | B2 | 8/2018 | Wilson et al. | | |
| 10,082,214 | B2 | 9/2018 | Wilson et al. | | |
| 2007/0051909 | A1 * | 3/2007 | Bernstein | F16K 7/065 | 251/9 |

* cited by examiner

FLUID DISPENSER WITH ANTI-RUN-ON

FIELD OF THE INVENTION

This application relates generally to fluid dispenser in a refrigerating appliance, a refrigerating appliance including a fluid dispenser, a method of dispensing a fluid, and a dispensing apparatus including a fluid dispenser.

BACKGROUND OF THE INVENTION

Conventional refrigeration appliances, such as domestic refrigerators, typically have both a fresh food compartment and a freezer compartment or section. Frequently, water, beverage, and/or ice dispensers are located on a fresh food compartment door or a freezer compartment door. FIG. 1 illustrates a prior art French door bottom mount freezer style refrigerator 10, having two French doors 16 enclosing a fresh food compartment, a sliding freezer door 12, and an outer case 14. Fluid and/or ice dispenser 18 may be located in a niche or inset 15 on a fresh food compartment door 16, as shown in FIG. 1. Generally, a fluid container is placed in the niche or inset below a dispensing nozzle. Then, by depressing a paddle or a button the water or beverage is dispensed through a nozzle. Depending on the mechanism used to dispense the water or beverage, deactivation of dispensing may not be immediate and a small amount water or beverage may continue to flow after the fluid container is removed, such occurrence being referred to as "run-on." Some niches or insets are equipped with a reservoir to collect such spilled water or beverage. It would be preferable to have a dispensing system which automatically prevents any excess dispensing when the fluid container is removed or the paddle is released.

SUMMARY OF THE INVENTION

The instant invention is fluid dispenser for a refrigerator with an anti-run-on feature.

In a first embodiment, the invention provides a fluid dispenser for a refrigerator comprising a dispenser housing; a dispenser frame pivotally mounted within the dispenser housing, the dispenser frame comprising a front face and two side faces and a first gear disposed on one of the side faces; an actuator comprising a paddle and a lever, the paddle pivotally mounted to the dispenser housing, the lever interlocking with the dispenser frame such that when the paddle is pushed, the lever causes the dispenser frame to pivot forward; a flexible and compressible tube with a dispensing open end mounted to the dispenser frame; a fixed compression jaw mounted onto the dispenser housing above a pivot point of the paddle and behind the flexible and compressible tube; a movable compression jaw having a jaw end and a pivot end, the jaw end mounted in front of the flexible and compressible tube and opposite the fixed compression jaw, wherein the pivot end comprises a second gear, the second gear interlocking with the first gear, such that when the paddle is pushed the first gear rotates the second gear moving the movable jaw away from the flexible and compressible tube.

In another embodiment, the water dispenser further includes a spring positioned between the pivot end of the movable jaw and the dispenser frame such that the movable jaw is biased against the tube and toward the fixed jaw when the paddle is not pushed.

In an alternative embodiment, the invention provides a water dispenser wherein at least one of the fixed and movable jaws have a flat face facing the tube.

The invention further provides an embodiment of the water dispenser wherein at least one of the fixed and movable jaws have two protrusions facing the tube.

In yet another embodiment, each of the fixed and movable jaws of the water dispenser have a flat face facing the tube. In another embodiment, each of the fixed and movable jaws of the water dispenser have two protrusions facing the tube and wherein the fixed and movable jaws are positioned such that the protrusions on the fixed jaw face the protrusions on the movable jaw.

In an alternative embodiment, the invention provides the water dispenser wherein a portion of the tube above the fixed and movable jaws connects to a water supply line. In another embodiment, the water supply line connects to a water filter upstream of the flexible and compressible tube.

In yet another embodiment, the water dispenser is located on an outside surface of a refrigerator door. In an alternative embodiment, the water dispenser is located on an inside surface of a refrigerator door. Alternatively, the water dispenser is located within a fresh food compartment of the refrigerator.

The invention further provides the water dispenser according to any of the embodiments described herein, wherein a distance which the paddle is pushed by a user is proportional to a remaining force applied by the movable jaw onto the flexible tube.

The invention also provides a refrigerator comprising the water dispenser of any embodiment herein.

The invention further provides a method to prevent or minimize fluid leakage from a fluid dispenser comprising the steps of: providing the water dispenser of claim 1; connecting a portion of the tube above the fixed and movable jaws to a fluid supply line; depressing the paddle of the actuator causing the movable jaw to move away from the tube, thereby dispensing fluid; releasing the paddle of the actuator causing the spring to bias the movable jaw forward against the tube, thereby compressing the tube between the movable and fixed jaws.

In an alternative method, the fluid supply line provides water, filtered water, or a flavored beverage to the flexible and compressible tube.

The invention further provides the method of any embodiment herein, wherein the depressing the paddle occurs to a variable distance resulting in a variable force being applied by the movable jaw to the tube resulting in variable flow rates through the flexible tube.

The invention further includes a fluid dispensing apparatus comprising any embodiment of the fluid dispenser described herein.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

DETAILED DESCRIPTION OF EMBODIMENTS OF THE INVENTION

Figure 1:
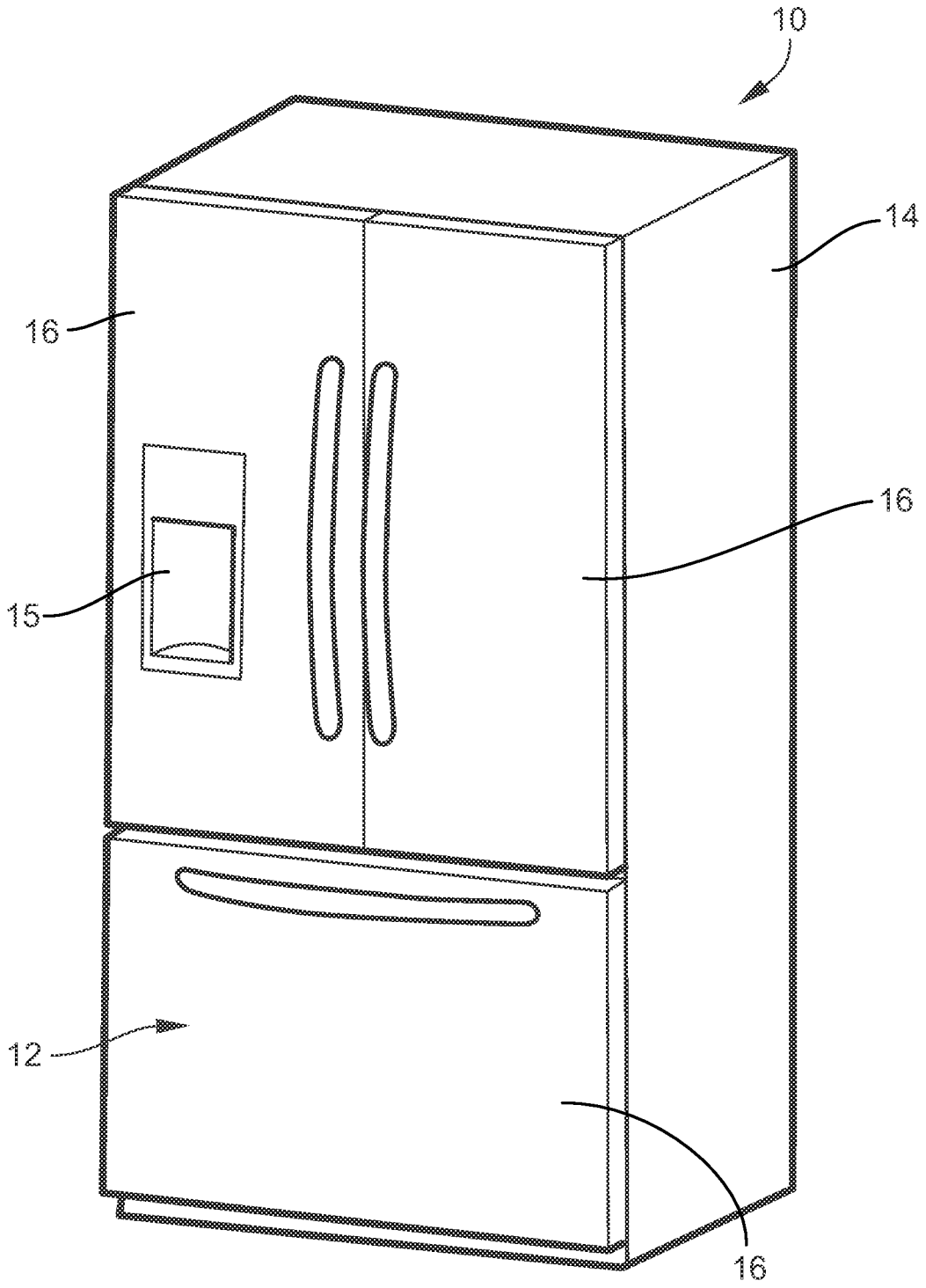
FIG. 1 is a front perspective view of a prior art household refrigeration appliance showing doors of the fresh food and freezer compartments in closed positions.

Embodiments of a refrigerating appliance or a component thereof now will be described with reference to the accompanying drawings. Whenever possible, the same reference numerals are used throughout the drawings to refer to the same or like parts.

Figure 2:
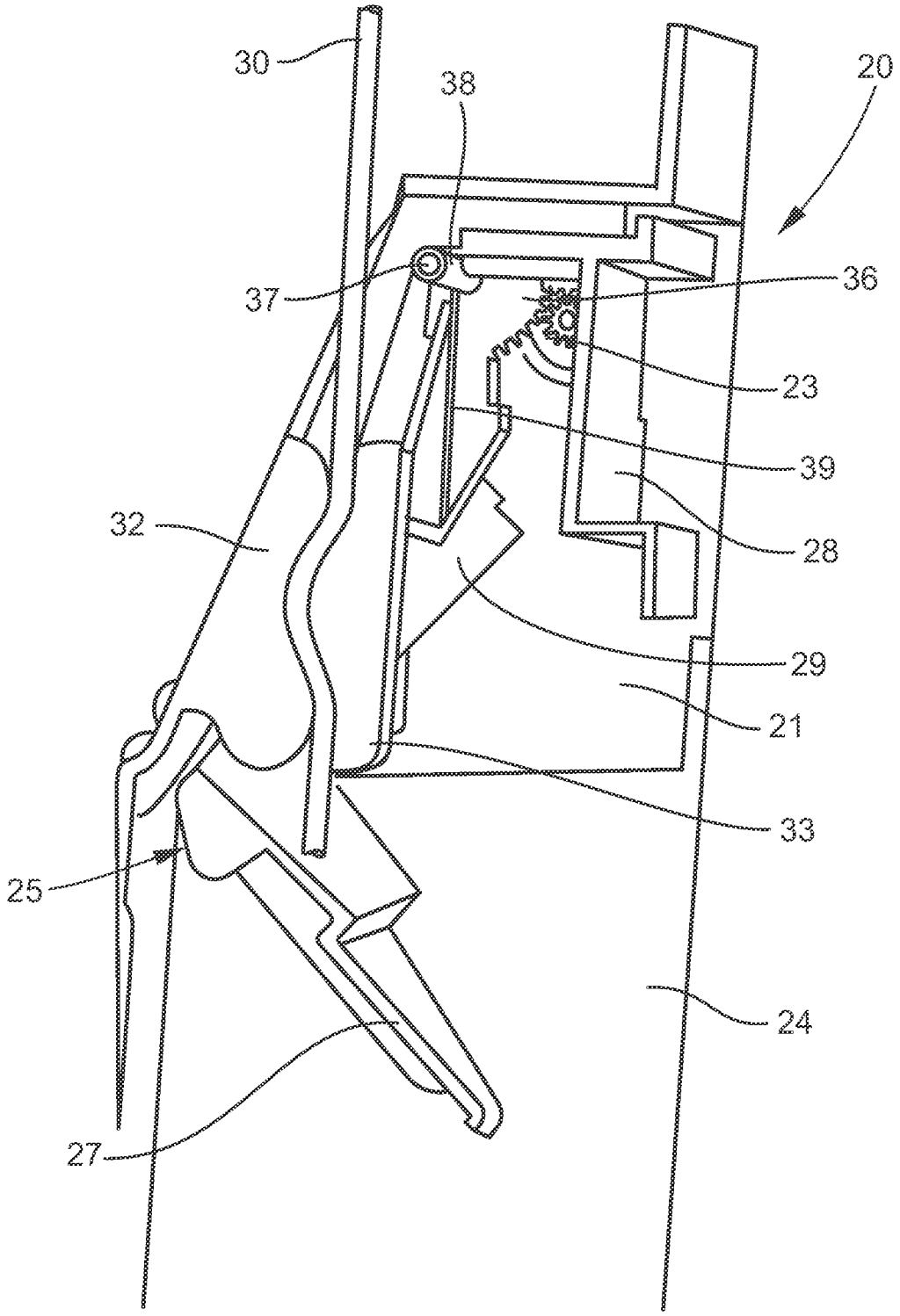
FIG. 2 is a side cross sectional view of a first embodiment of the fluid dispenser.

Referring first to FIG. 2, a side cross sectional view of a first embodiment of the fluid dispenser 20 is shown. In FIG. 2, the dispenser 20 is located in a niche or inset 22. The fluid dispenser 20 includes a dispenser housing 24, a dispenser frame 26 pivotally mounted within the dispenser housing 24. The dispenser frame 26 Includes a front face 28 and two side faces 21 (only one shown in the cross-sectional view) and a first gear 23 disposed on one of the side faces 21. The fluid dispenser 20 further includes an actuator 25 which in turn includes a paddle 27 and a lever 29. The paddle 27 is pivotally mounted to the dispenser housing 24. The lever 29 interlocks with the dispenser frame 26 such that when the paddle 27 is pushed, the lever 29 causes the dispenser frame 26 to pivot forward.

The fluid dispenser 20 further includes a flexible and compressible tube 30 with a dispensing open end 31 mounted to the dispenser frame 26. A fixed compression jaw 32 is mounted onto the dispenser housing 24 above a pivot point 32 of the paddle 27 and behind the flexible and compressible tube 30. A movable compression jaw 33 has a jaw end 34 and a pivot end 35. The jaw end 34 of the movable compression jaw 33 is mounted in front of the flexible and compressible tube 30 and opposite the fixed compression jaw 32. The pivot end 35 of the movable compression jaw 33 includes a second gear 36 which interlocks with the first gear 23.

Figure 3:
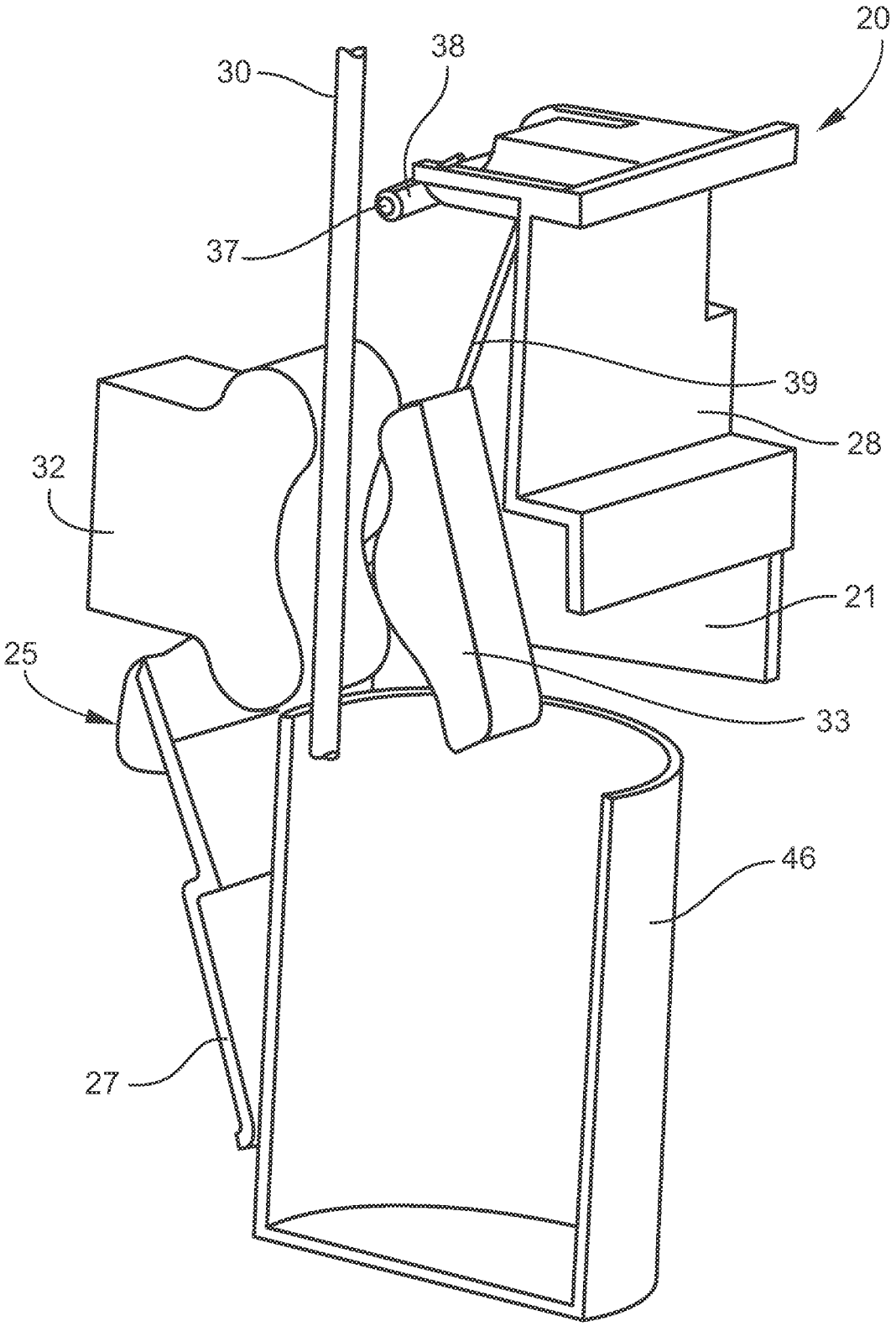
FIG. 3 is a side perspective partial cross-sectional view of the embodiment shown in FIG. 2 wherein the fluid dispenser is shown in an open position.

When the paddle 27 is pushed backward, the first gear 23 rotates the second gear 36 causing the movable compression jaw 33 to move away from the flexible and compressible tube 30, as shown in FIG. 3. FIG. 3 further illustrates a fluid container 46 in cross section pushing the paddle 27 backward. When the movable compression jaw 33 moves away from the flexible and compressible tube 30 and the fixed compression jaw 32, fluid is allowed to flow through the flexible and compressible tube 30 in which a constant fluid pressure is maintained. In FIG. 2, the movable compression jaw 33 is held in a closed position in which the movable compression jaw 33 is biased against the flexible and compressible tube 30 and the fixed compression jaw 32 thereby preventing any fluid held in the tube 30 from flowing out of open end 31.

As seen in FIG. 2, when paddle 27 is not pushed, spring 37 holds movable compression jaw 33 biased against the flexible and compressible tube 30, thereby pinching tube 30 and preventing any fluid flow through tube 30. Spring 37 is positioned between the pivot end 35 of the movable compression jaw 33 and the dispenser frame 26. Spring 37 includes a coiled section 38 and a biasing arm 39.

In the embodiment illustrated in the FIGS. 2 and 3, the fixed and movable jaws 32 and 33, respectively, have protrusions 40 facing the tube 30. In alternative embodiments, one or both of the fixed and movable jaws 32 and 33 may have a flat face facing the tube. Alternative profiles of the fixed and movable jaws 32 and 33 may be used provided such profiles are capable of pinching the tube 30 so as to restrict fluid flow through tube 30. In yet another embodiment, the fixed and movable jaws have complementary shapes, such as an S-shape and a reverse S-shape, so that the contact area of pinching the flexible tube between the jaws is maximized.

Figure 4:
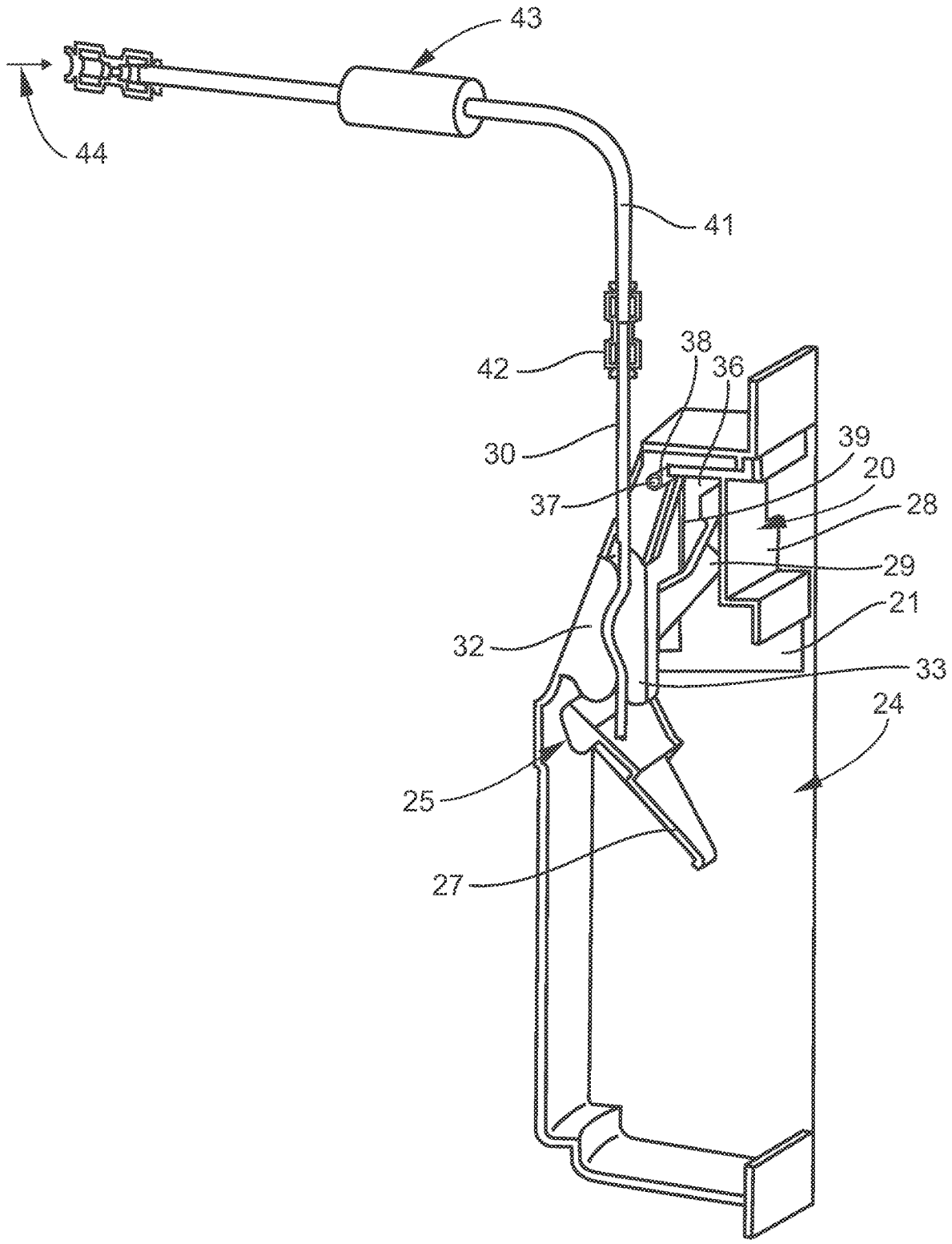
FIG. 4 is a side perspective partial cross-sectional view of the embodiment shown in FIG. 2 wherein the fluid dispenser is shown connected to a water supply line.

As can be seen from the foregoing discussion and FIGS. 2 and 3, a variable force on paddle 27 can result in a variable compression of tube 30 by movable jaw 33. Accordingly, the inventive fluid dispenser may dispense a fluid at a variable rate depending upon the amount of compression of tube 30, FIG. 4 illustrates the fluid dispenser 20 connected to a water supply line 41. In the embodiment illustrated in FIG. 4, the flexible and compressible tube 30 is connected by connecting mechanism 42 to a more rigid water supply line 41. Water supply line 41 may be made of the same material as the flexible and compressible tube 30, or alternatively, of a more rigid plastic or polymer material, or of a metal material. As shown in FIG. 4, water supply line 41 supplies water which has been filtered through an in-line filter 43. Water supply line 41 ultimately connects to a water supply 44 which may be a residence water supply, water bottle or other source. In an alternative embodiment, flexible and compressible tube 30 connects to an alternative fluid supply, such as a source of soda, juice or the like. It will be understood that the inventive fluid dispenser may be used in connection with dispensing any fluid but is particularly useful in connection with dispensing fluids typically dispensed from refrigerating appliance. Likewise, it will be understood that the inventive fluid dispenser may be used in a niche which includes other dispensers, such as ice dispensers. When used in conjunction with an ice or other dispenser, the inventive fluid dispenser may be disposed in solely a part of a niche or inset.

Figure 5:
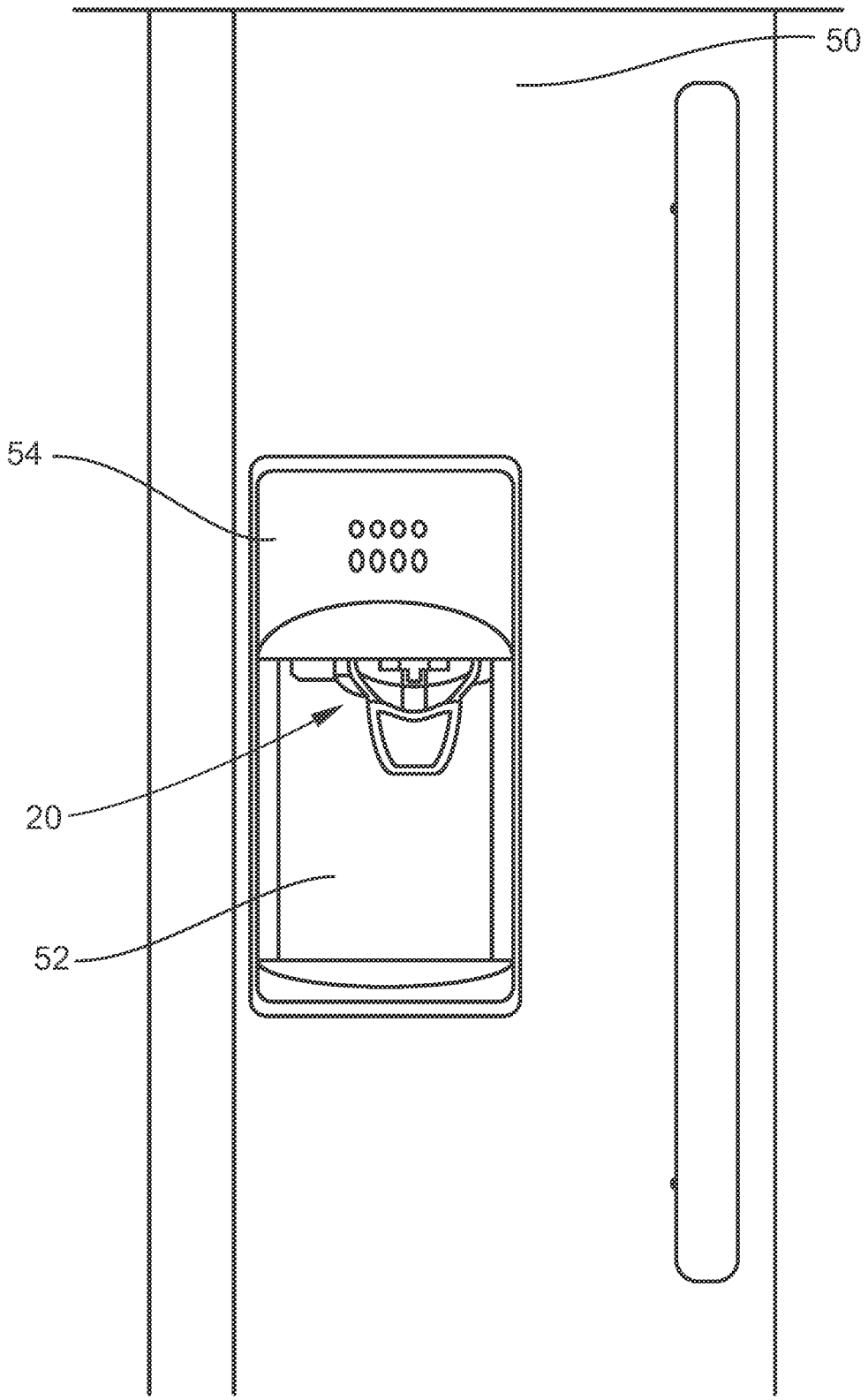
FIG. 5 is a front elevational view of an embodiment of the fluid dispenser installed in a niche of a door.

The invention further provides a refrigerator having the inventive fluid dispenser. FIG. 5 illustrates the fluid dispenser 20 on the outside surface of a refrigerator door 50 and in a niche 52 located on the door. In FIG. 5, the dispensing frame 26 is covered by a decorative faceplate 54. In alternative embodiments, the fluid dispenser may be located on an inside surface of a refrigerator door, or within a fresh food compartment, such as on or within a fresh food compartment liner. Moreover, any form of refrigerator may accommodate the inventive fluid dispenser. The inventive fluid dispenser may be used with, in or on a French door bottom mount refrigerator as shown in FIG. 1, or alternatively, with top freezer mount refrigerators, side by side refrigerators, multi-door refrigerators, mini or compact refrigerators, or independent refrigerating units.

The invention further provides a method to prevent or minimize fluid leakage from a fluid dispenser which includes the steps of providing the fluid dispenser as described herein, connecting a portion of the tube above the fixed and movable jaws to a fluid supply line; depressing the paddle of the actuator causing the movable jaw to move away from the tube, thereby dispensing fluid; releasing the paddle of the actuator causing the spring to bias the movable jaw forward against the tube, thereby compressing the tube between the movable and fixed jaws. In a particular embodiment of the inventive method, the fluid supply line provides water to the flexible and compressible tube. The fluid supply line may provide filtered water, or alternatively, a flavored beverage to the flexible and compressible tube.

In another embodiment of the invention, the depressing the paddle occurs to a variable distance resulting in a variable force being applied by the movable jaw to the tube resulting in variable flow rates through the flexible tube.

In another embodiment, the invention provides a fluid dispensing apparatus comprising the fluid dispenser as described herein. Such fluid dispensing apparatus could be, for example, a countertop fluid dispenser or a floor mounted fluid dispenser. In alternative embodiments, the fluid dispensing apparatus may dispense by way of example, water, juice, milk, flavored beverages, such as sodas, or teas. In yet another alternative embodiment, the fluid dispensing apparatus may include a heating unit to dispense hot fluids, such as coffee, hot teas, hot chocolate milk, or the like.

What is claimed is:

1. A fluid dispenser for a refrigerator comprising;

a dispenser housing;

a dispenser frame pivotally mounted within the dispenser housing, the dispenser frame comprising a front face and two side faces and a first gear disposed on one of the side faces: an actuator comprising a paddle and a lever, the paddle pivotally mounted to the dispenser housing, the lever interlocking with the dispenser frame such that when the paddle is pushed, the lever causes the dispenser frame to pivot forward;

a flexible and compressible tube with a dispensing open end mounted to the dispenser frame;

a fixed compression jaw mounted onto the dispenser housing above a pivot point of the paddle and behind the flexible and compressible tube;

a movable compression jaw having a jaw end and a pivot end, the jaw end mounted in front of the flexible and compressible tube and opposite the fixed compression jaw, and a spring positioned between the pivot end of the movable jaw and the dispenser frame; and wherein the pivot end comprises a second gear, the second gear interlocking with the first gear, such that when the paddle is pushed the first gear rotates the second gear moving the movable jaw away from the flexible and compressible tube.

2. The water dispenser of claim 1, wherein the movable jaw is biased against the tube and toward the fixed jaw when the paddle is not pushed.

3. The water dispenser of claim 1, wherein at least one of the fixed and movable jaws have a flat face facing the tube.

4. A fluid dispenser for a refrigerator comprising;

a dispenser housing;

a dispenser frame pivotally mounted within the dispenser housing, the dispenser frame comprising a front face and two side faces and a first gear disposed on one of the side faces: an actuator comprising a paddle and a lever, the paddle pivotally mounted to the dispenser housing, the lever interlocking with the dispenser frame such that when the paddle is pushed, the lever causes the dispenser frame to pivot forward;

a flexible and compressible tube with a dispensing open end mounted to the dispenser frame;

a fixed compression jaw mounted onto the dispenser housing above a pivot point of the paddle and behind the flexible and compressible tube;

a movable compression jaw having a jaw end and a pivot end, the jaw end mounted in front of the flexible and compressible tube and opposite the fixed compression jaw, and at least one of the fixed and movable jaws have two protrusions facing the tube; and wherein the pivot end comprises a second gear, the second gear interlocking with the first gear, such that when the paddle is pushed the first gear rotates the second gear moving the movable jaw away from the flexible and compressible tube.

5. The water dispenser of claim 1, wherein each of the fixed and movable jaws have a flat face facing the tube.

6. A fluid dispenser for a refrigerator comprising;

a dispenser housing;

a dispenser frame pivotally mounted within the dispenser housing, the dispenser frame comprising a front face and two side faces and a first gear disposed on one of the side faces: an actuator comprising a paddle and a lever, the paddle pivotally mounted to the dispenser housing, the lever interlocking with the dispenser frame such that when the paddle is pushed, the lever causes the dispenser frame to pivot forward;

a flexible and compressible tube with a dispensing open end mounted to the dispenser frame;

a fixed compression jaw mounted onto the dispenser housing above a pivot point of the paddle and behind the flexible and compressible tube;

a movable compression jaw having a jaw end and a pivot end, the jaw end mounted in front of the flexible and compressible tube and opposite the fixed compression jaw, and each of the fixed and movable jaws have two protrusions facing the tube and wherein the fixed and movable jaws are positioned such that the protrusions on the fixed jaw face the protrusions on the movable jaw; and wherein the pivot end comprises a second gear, the second gear interlocking with the first gear, such that when the paddle is pushed the first gear rotates the second gear moving the movable jaw away from the flexible and compressible tube.

7. The water dispenser of claim 1, wherein a portion of the tube above the fixed and movable jaws connects to a water supply line.

8. The water dispenser of claim 6, wherein the water supply line connects to a water filter upstream of the flexible and compressible tube.

9. The water dispenser of claim 1, wherein the water dispenser is located on an outside surface of a refrigerator door.

10. The water dispenser of claim 1, wherein the water dispenser is located on an inside surface of a refrigerator door.

11. The water dispenser of claim 1, wherein the water dispenser is located within a fresh food compartment of the refrigerator.

12. The water dispenser of claim 1, wherein a distance which the paddle is pushed by a user is proportional to a remaining force applied by the movable jaw onto the flexible tube.

13. A refrigerator comprising the water dispenser of claim 1.

14. A fluid dispensing apparatus comprising the fluid dispenser of claim 1.

* * * * *